US006935878B2

(12) United States Patent
Hsu et al.

(10) Patent No.: US 6,935,878 B2
(45) Date of Patent: Aug. 30, 2005

(54) ELECTRICAL PLUG WITH PIVOTABLE AND RETRACTABLE TERMINALS

(75) Inventors: Jung-Hui Hsu, Hsin Chuang (TW); Chia-Cheng Wei, Chung Ho (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/796,985

(22) Filed: Mar. 11, 2004

(65) Prior Publication Data

US 2005/0153587 A1 Jul. 14, 2005

(30) Foreign Application Priority Data

Jan. 9, 2004 (TW) ..... 93200395 U

(51) Int. Cl.[7] ..... H01R 29/00

(52) U.S. Cl. ..... 439/171; 439/172; 439/173; 439/174

(58) Field of Search ..... 439/52, 53, 103, 439/104, 105, 106, 171, 172, 173, 174, 218, 439/518

(56) References Cited

U.S. PATENT DOCUMENTS

| | | | | |
|---|---|---|---|---|
| 6,190,184 | B1 * | 2/2001 | Cimbal et al. | 439/131 |
| 6,419,504 | B1 * | 7/2002 | Nelson | 439/103 |
| 6,749,451 | B2 * | 6/2004 | Schmitt | 439/218 |
| 6,790,062 | B1 * | 9/2004 | Liao | 439/171 |

* cited by examiner

*Primary Examiner*—Chandrika Prasad
(74) *Attorney, Agent, or Firm*—Troxell Law Office, PLLC

(57) ABSTRACT

The present invention discloses a link assembly for connectors, which comprises a main body, a live terminal, a neutral terminal, a ground terminal, and a push rod. The live terminal and the neutral terminal are bent directly under two wire sockets of the main body and turned round and extended out from the wire sockets to form a two-terminal connector, or pressed by the push rod to move a support member downward from a positioning channel at one end of a guide channel of the main body to push against the inner wall of the wire socket to move forward to another end of the positioning channel. The support member is latched by a resilient member, such that the ground terminal is extended out from the ground wire hole and the live and neutral terminals are turned round and extended out from the wire socket to drive the latch member and press on a blocking member to constitute a 3-termainal connector.

7 Claims, 6 Drawing Sheets

ELECTRICAL PLUG WITH PIVOTABLE AND RETRACTABLE TERMINALS

FIELD OF THE INVENTION

The present invention relates to a link assembly for connectors, more particularly to a two-terminal connector or a three-terminal connector having a ground terminal passing in and out a main body of the connector as needed. Further, the present invention may comprise a latch device to serve as a basis for turning round the live and neutral terminals, so that the live and neutral terminals cannot be used if the ground terminal has not passed in or out the connector.

BACKGROUND OF THE INVENTION

In general, the design of a prior-art power circuit uses a plug-and-socket relation for an electric connection to supply power supply to a household electric appliance. Such application is generally used in many countries of the world. The only difference resides on the shape and width of the plugs and sockets.

A plug usually comes with two conductive plates or terminals extended outward for being inserted into a socket hole of a socket. Undeniably, the tight attachment of the two determines the quality of circuit connection; if the attachment is too loose, the conductive plates will be separated from the socket hole easily. Therefore, attention should be paid to the tight attachment for a secured connection.

Based on the safety consideration, it is necessary to have a ground wire or a ground bracket with the grounding effect on the live and neutral plugs or socket as required in many countries such as England and the United States to prevent electric leakage.

Since the safety specifications for plugs and sockets in different countries are different, therefore connectors are divided into 2-terminal connectors and 3-terminal connectors. However, the plug and socket manufacturers usually build a ground terminal on the connector to avoid a high inventory of different extension cords. However, such ground terminals cannot be plugged into the sockets in some countries such as Taiwan and Japan, because there is no ground socket hole for the insertion. Therefore, the design for adapting both 2-terminal and 3-terminal connections comes into place, but the length of the connector after inserting the adaptor will be increased greatly. The increased weight of the connector also causes the connector to fall off from the socket easily. Another solution is to cut off the ground terminal for disabling the grounding function.

Further, in order to avoid the exposure of the live and neutral terminals from the power cables and extension cords for some traveling electric appliances such as an electric razor or an information product, the terminals are designed in an U-shape or contractible form, so that the terminals can be extended outside or withdrawn inside. However, some countries like the United States have strict safety specification on sockets with grounding wire holes. In other words, if the ground terminal is not extended outside, the live and neutral terminals cannot be plugged. Therefore, designing a link assembly to meet the requirements of such specification is a subject for connector manufacturers.

SUMMARY OF THE INVENTION

In view of the shortcomings of the prior art as described above, the inventor of the present invention based on years of experience on designing and selling plugs and sockets to conduct researches and experiments to overcome the foregoing shortcomings, and finally invented the "LINK ASSEMBLY FOR CONNECTORS" in accordance with the present invention.

The primary objective of the present invention is to provide a link assembly for connectors, comprising: a main body having a guide channel on one end surface, a positioning channel at both ends of the guide channel, a terminal channel disposed at both vertical sides of the guide channel, and a ground wire hole disposed between the two terminal channels; a live terminal and a neutral terminal having an insulated axle rod installed at both ends of the live and neutral terminals and connected to the interior of the main body such that the two terminals can be turned round and extended out of the terminal channel, wherein at least one latch is extended from the rear side of the axle rod; a ground terminal, having an insulated base installed at one end of a ground terminal, a latch groove along the longitudinal direction, and a blocking member protruded from the bottom; a push rod, having a resilient member coupled to the bottom of the push rod and inserted into the latch groove, at least one support member protruded from the upper wall of the rod corresponding to the positioning channel; so that the live terminal and the neutral terminal are bent directly under the terminal channels and turned round to extend out from the terminal channel and constitute a 2-terminal connector; or the push rod being pushed to drive the support member to move down in the positioning channel and press on the inner wall of the terminal channel and push the support member forward to another end of the positioning channel. The support member is latched by the extension of the resilient member, and the ground terminal is extended out from the ground wire hole, and the live terminal and the neutral terminal are turned round and extended out from the terminal channels such that the latch presses the support member to constitute a 3-terminal connector.

The secondary objective of the present invention is to provide a link assembly for connectors, further comprising a latch device installed at the opening of the ground wire hole between the terminal channels and being sheathed into a seal lid by a contractible member and one side of the blocking plate is extended out from the plate groove of the seal lid to shut a terminal channel. An aslant surface is disposed on the contractible member; a resilient member is coupled indirectly to the stop latch on other side of the seal lid; a sliding member is protruded from the base of the ground terminal corresponding to the aslant surface. The sliding member moves forward and touches the aslant surface to moves its side such that the blocking plate is withdrawn into the seal lid to open the terminal channel and turn the live terminal and the neutral terminal round towards the outside.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
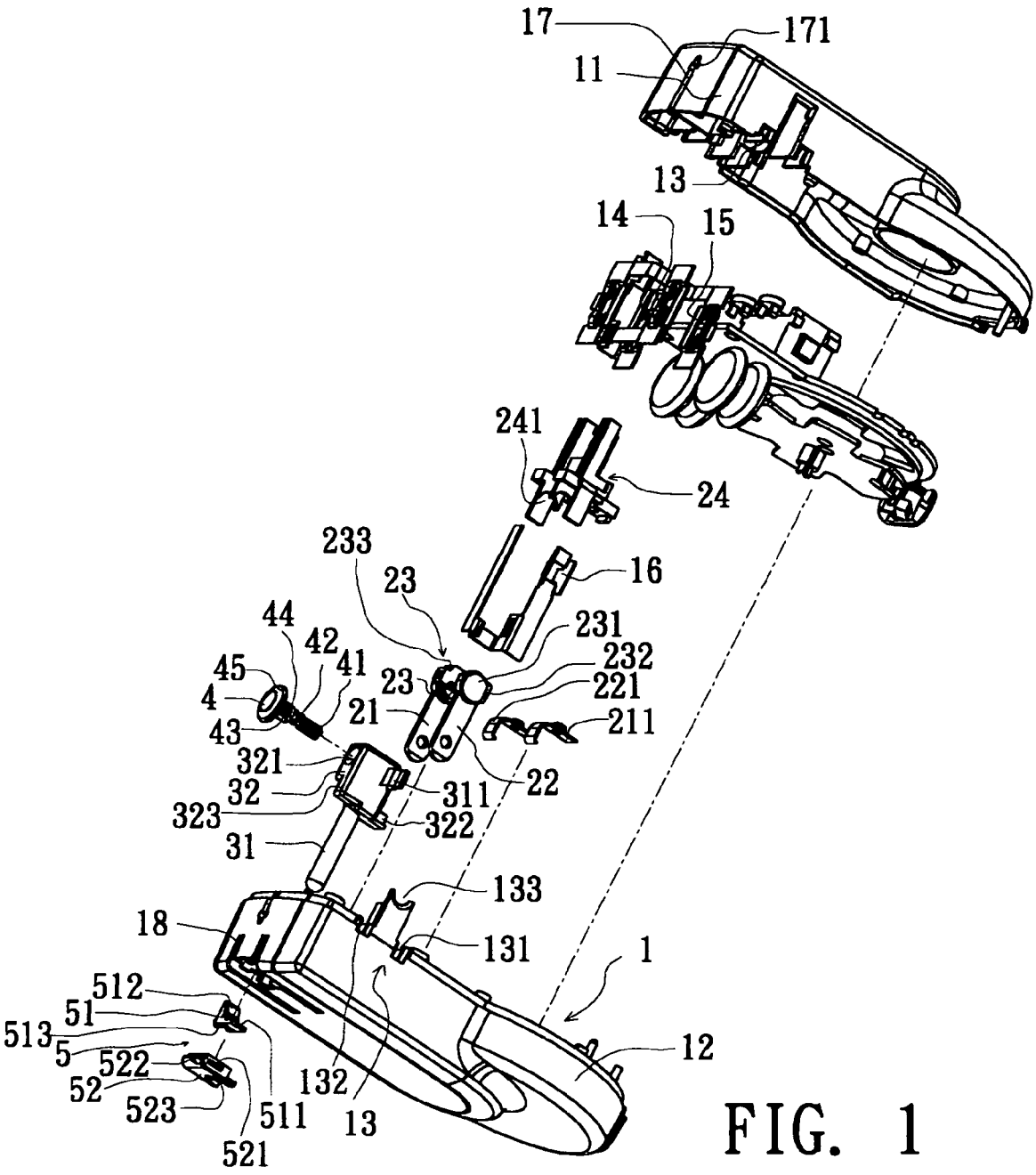
FIG. 1 is an exploded view of the connector according to the present invention.
Figure 2:
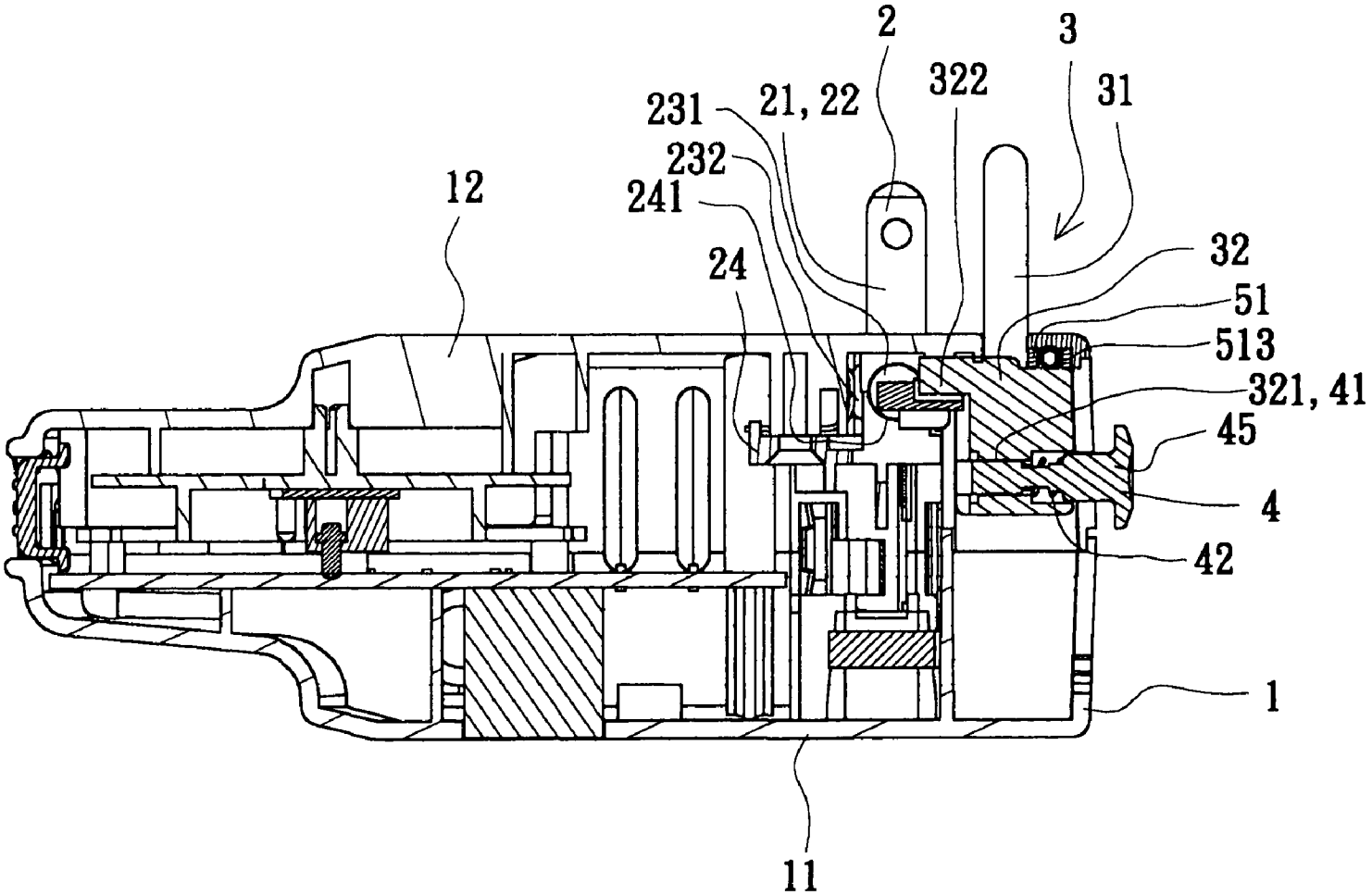
FIG. 2 is a cross-sectional view of the assembled structure of the connector as depicted in FIG. 1.

Please refer to FIGS. 1 and 2 for the connector according to the invention, which comprises a main body 1, a live and neutral terminal module 2, a ground terminal module 3, a push rod 4, and a latch device 5.

The main body 1 is a base for accommodating and mounting the live and neutral terminal module 2, ground terminal module, push rod 4, and latch device 5. In the figure, the main body 1 comprises an upper casing 11 and a lower casing 12 coupled with each other, and a connector module 13 comprised of live and neutral wire insert holes 131, 132 and a ground wire insert hole 133 for receiving the live and neutral terminal and the ground terminal of other plug and being in contact with the internal live and neutral terminals 14, 15 and ground terminal 16, so that the main body 1 acts as an extended connector. However, such extended connector is a prior art, and thus will not be described here.

The technical characteristics of the invention reside on that a guide channel 17 is disposed on top surface of the main body 1 proximate to an end coupled to the connector module 13 corresponding to the push rod 4, and a terminal channel 18 is extended downward from both sides at the front of the guide channel 17, and a positioning channel 171 is formed at both ends of the guide channel 17, such that the push rod 4 can be protruded for the latch, and the ground terminal 31 can be movably positioned for extending the ground terminal 31 outside or withdraw it inside. A live terminal 21 and a neutral terminal 22 are accommodated and fixed into the two terminal channels 18, and the two terminals 21, 22 can be turned round to be erected vertically from the bottom of the terminal channel 18 for the electrical connection. In particular, a ground wire hole 181 is disposed between the two terminal channels 18 for extending or drawing the ground terminal 31.

The end of a live terminal 21 and a neutral terminal 22 in the live and neutral terminal module 2 are pivotally coupled to an axle rod 23, and an axle ring 231 is formed at each end for connecting the two circular concave axle arcs 241 of a limit press board 24 such that a long protrusion 232 is protruded from the bottom of the axle ring 231, and both live and neutral terminals 21, 22 can be turned round 90 degrees. In addition, two press latches 233 are protruded from the bottom of the axle rod 23 to constitute a link relation with the base 32. Further, the limit press board 24 is disposed between the upper casing 11 and the lower casing 12 to limit the position of the live and neutral terminals 21, 22, thus the live and neutral terminals 21, 22 will not deviate from their positions when they are turned round, and the live and neutral terminals 21, 22 and the connecting plates 14, 15 are in contact with each other by means of a relay plate 14, 15 for supplying electric power to the connector module 13.

The ground terminal module 3 disposed on a base 32 comprises a ground terminal 31 at its end, a pair of clamping plates 311 protruded laterally from the base 32 for clamping the ground wire connecting plate 16 to constitute an electric connection, a through latch channel 321 disposed vertically on the base 32, a T-shape blocking member 322 protruded from the bottom, and a sliding member 323 protruded from the side of the base 32. Further, the ground terminals 21, 22 are turned round 90 degrees and both press latches 233 of the axle rod 23 press against the rear opening of the blocking member 322 such that the ground terminal 31 will not be withdrawn.

The push rod 4 is a button member; before the rod latch 41 under the push rod 41 is connected to the latch groove 321, the rod latch 41 is connected to a resilient member 42 such as a spring, and a support 44 is protruded from both sides of the upper rod wall 43, and a press button 45 is disposed on the rod wall 43. The rod latch 41 and the positioning channel 171 are preferably but not limited to the shape of a cross.

If it is necessary to push out the ground terminal 31, the push rod 4 is pressed downward, so that the rear side of the positioning channel 171 compresses the resilient member 42 and the two support members 44 press the inner wall of the guide channel 17, and then the press button 45 is pushed forward such that the ground terminal 31 is gradually extended out from the ground wire hole 19 until the two support members 44 reach the front of the positioning channel 171 and are extended by the resilient member 42 and latched into the positioning channel 171. Then, the live and neutral terminals 21, 22 are bent downward to turn round at 90 degrees and then erected vertically under the two terminals 18. The two press latches 233 at the interior of the rear section are pressed on the rear side of the T-shaped blocking member 322, so that the ground terminal 31 will not be withdrawn. The first preferred embodiment of the invention does not need to purchase an additional adaptor or cut the ground terminal off to meet the requirements of adapting the 2-terminal connection or the 3-terminal connection.

The present invention further comprises a latch structure 5 installed at the opening above the foregoing ground wire hole 19 and a blocking plate 511 at one end of a contractible member 51 being extend out of a plate groove 521 of a seal lid 52, and accommodated inside. An aslant surface 512 is protruded from another end of the contractible member 51, and a resilient member 513 such as a spring is installed on the end surface. The other end of the resilient member 513 presses a stop latch 522 protruded from the seal lid 52, and the a lid arc 523 is formed on the lid corresponding to the ground wire hole 19 for allowing the ground terminal to be extended outside.

Figures 3A, 3B:
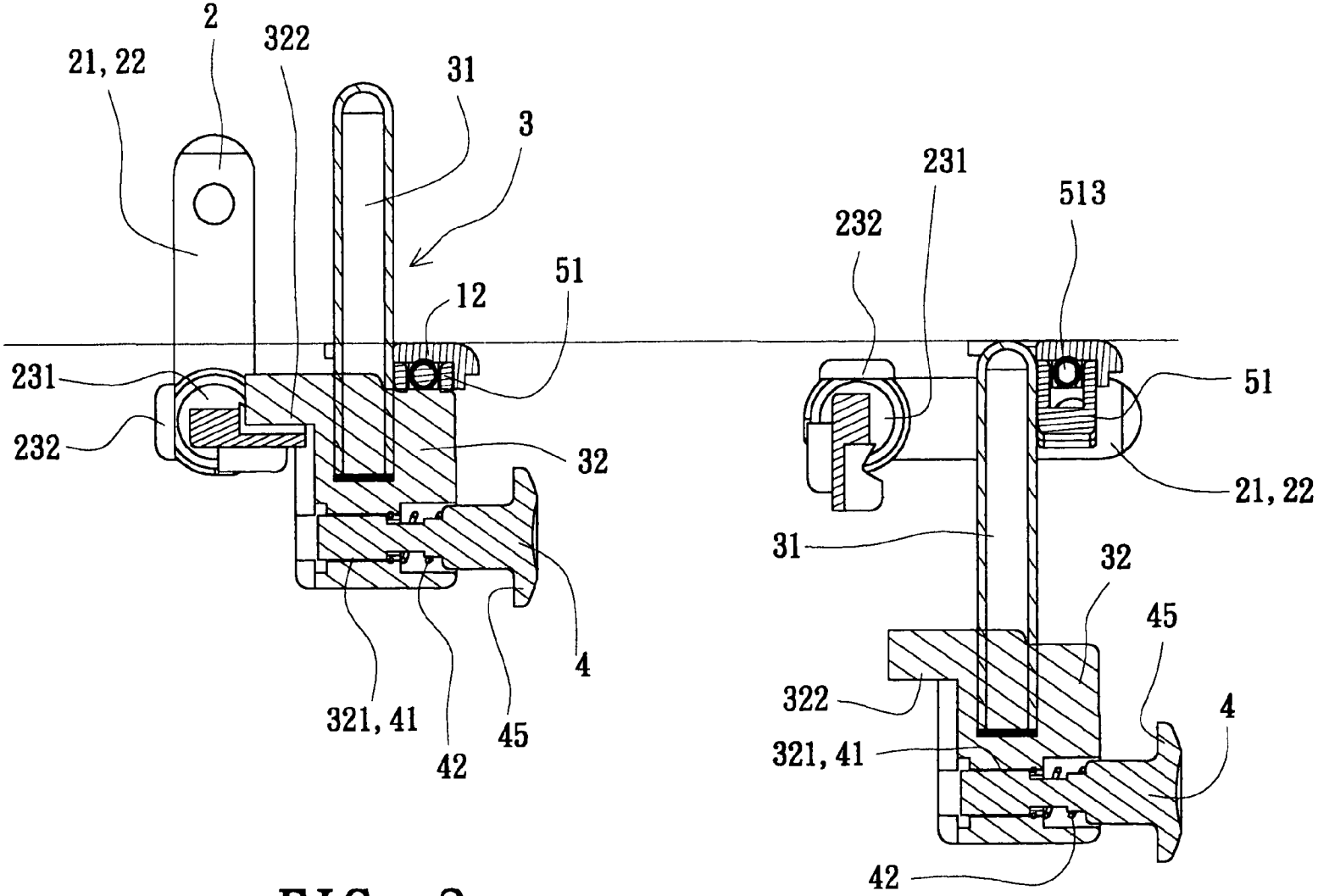
FIGS. 3*a* and 3*b* are cross-sectional views of the according to the present invention before and after it is operated respectively.
Figure 4B:
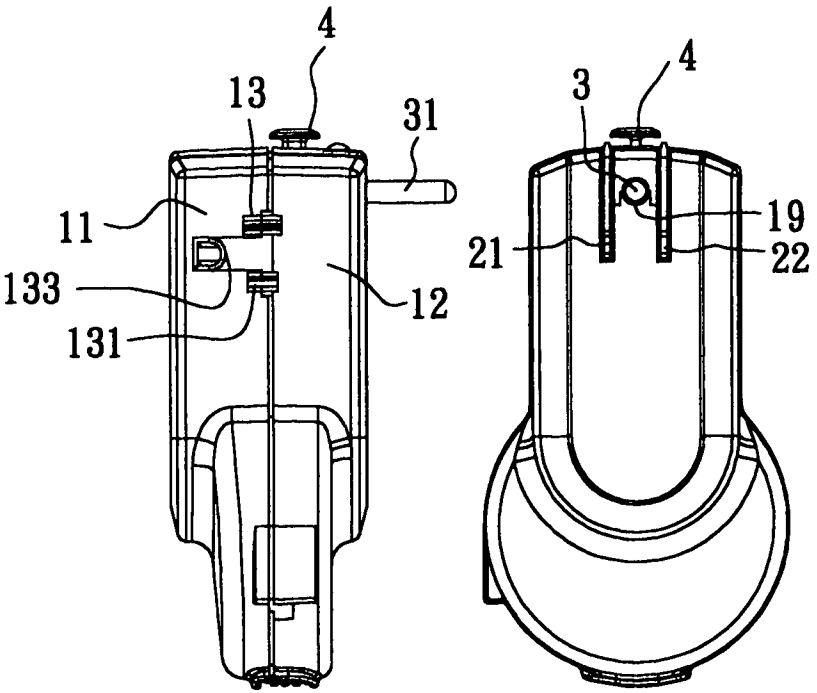
FIGS. 4*a* to 4*e* are side views and front views of the operating procedure according to the present invention.
Figure 4A:
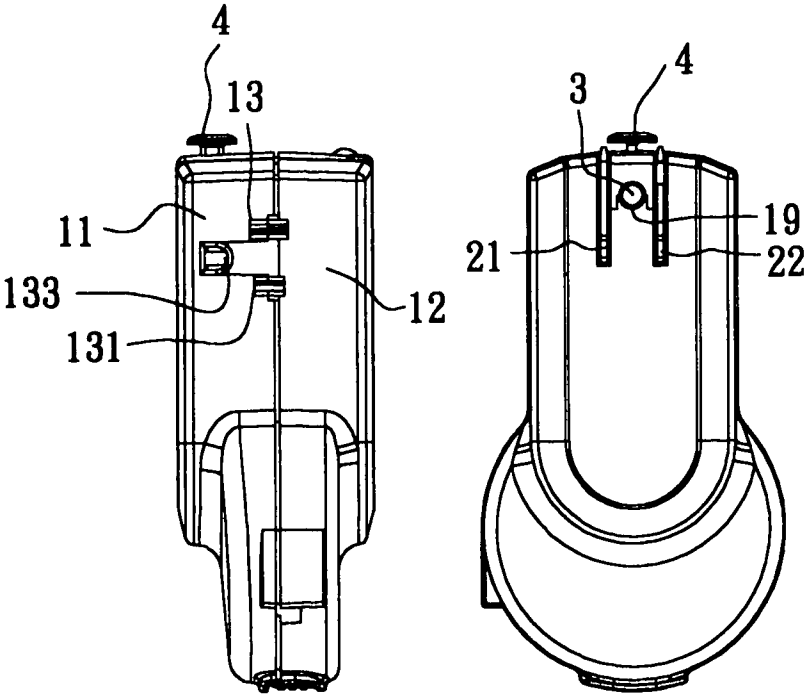
Figure 4D:
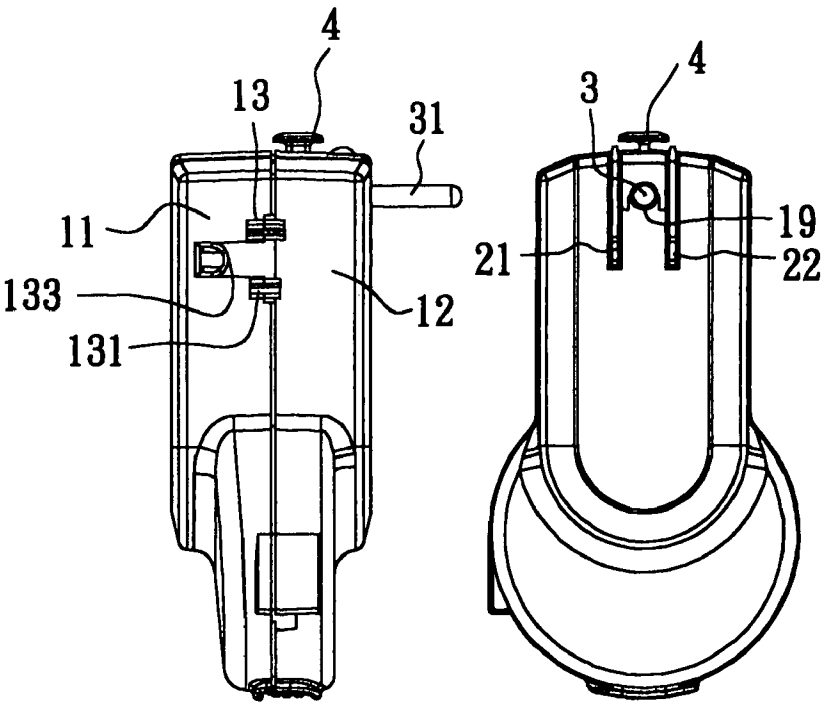
Figure 4C:
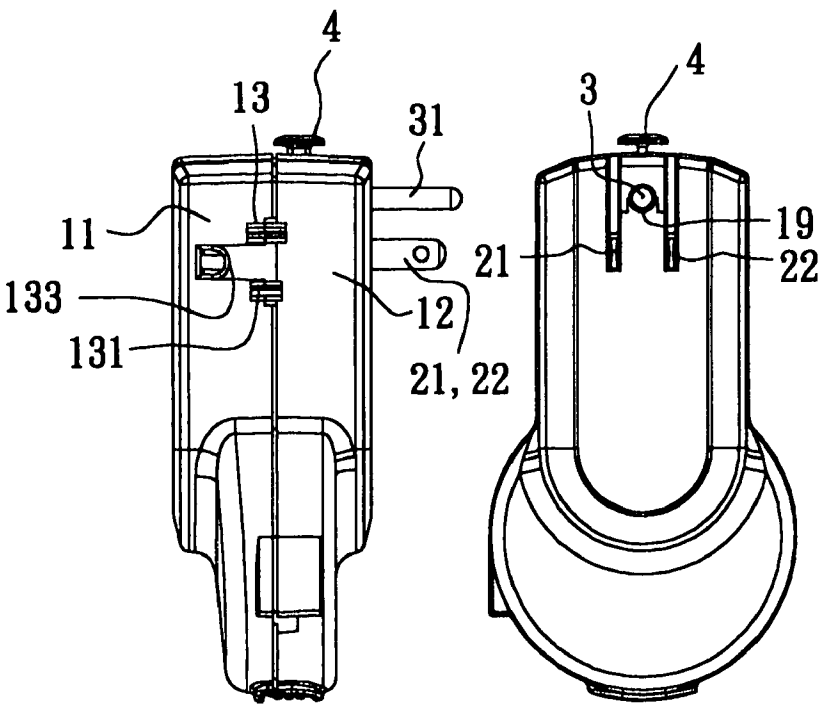
Figure 4E:
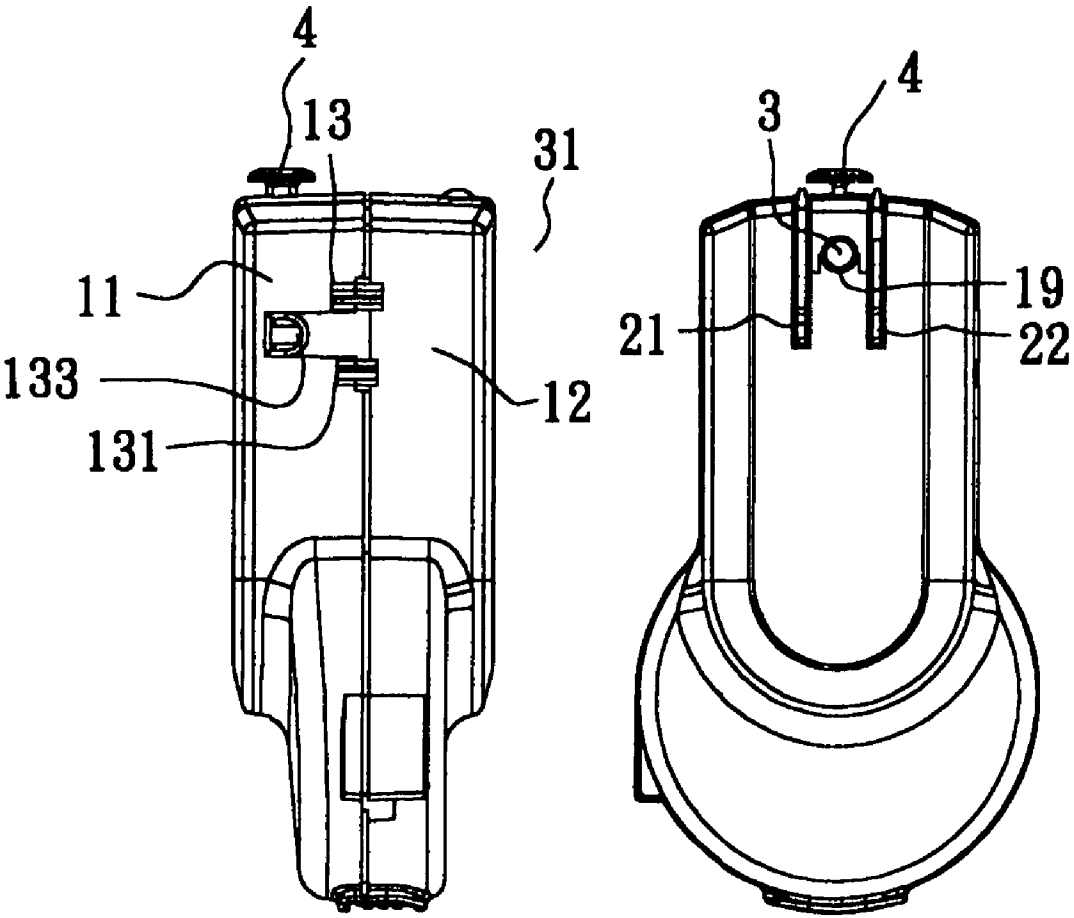

In FIGS. 3*a* to 4*b*, if a user pushes the ground terminal 31 out according to the aforementioned procedure, the sliding member on the lateral side of the base 323 pushes the aslant surface 512 and compresses the resilient member 513, such that the blocking plate 521 is withdrawn from the plate groove 521 into the seal lid 52. Then, a terminal channel 18 is opened to turn the live terminal 21 and the neutral terminal 2 round at 90 degrees as shown in FIGS. 3 and 4*c*. If it is necessary to withdraw the terminals, the live terminal 21 and the neutral terminal 22 are turned round in the reverse direction. After the press latch 233 and the blocking member 322 are detached (as shown in FIG. 4*d*), the push rod 4 are pressed to withdraw backward, so that the aslant surface 512 of the contractible member 51 extends the blocking plate 511 from the plate groove 521 by the extension of the resilient member 513, since the sliding member 323 is separated to shut a terminal channel 18 as shown in FIGS. 2 and 4*e*. The second preferred embodiment of the invention discloses a connector, wherein the ground terminal 31 must be pushed out before being used, and the ground terminal 31 is withdrawn into the main body 1 after the ground terminal is stored, and thus the live terminal 21 and the ground terminal 22 cannot be used individually by themselves. Such arrangement complies with the requirements of the safety specifications for the 3-terminal connector in most countries, and the present invention is definitely a great novel idea.

In summation of the above description, the present invention enhances the performance of the conventional structure, and further complies with the patent application requirements and is submitted to the Patent and Trademark Office for review and granting of the commensurate patent rights.

What is claimed is:

1. A link assembly for connectors, comprising:

a main body, having a guide channel disposed at one end surface, a positioning channel disposed at both ends of said guide channel, a terminal channel disposed at both vertical sides of said guide channel, and a ground wire hole disposed between said two terminal channels;

a live wire and neutral terminal module, having an insulated axle rod installed at both ends of said live and neutral terminal module and connected to the interior of said main body, such that said two terminals being turned round and extended out of said terminal channel, wherein at least one latch is extended from the rear side of said axle rod;

a ground terminal module, having an insulated base installed at one end of a ground terminal, a latch groove disposed along the longitudinal direction, and a blocking member protruded from the bottom;

a push rod, having a resilient member coupled to the bottom of said push rod and inserted into said latch channel, at least one support member protruded from the upper wall of said push rod corresponding to said positioning channel;

said live terminal and neutral terminal being bent directly under said terminal channels and turned round to extend out from said terminal channel to define a 2-terminal connector; and alternatively said push rod being pushed to drive the support member to move down in said positioning channel and press on the inner wall of said terminal channel and push said support member forward to another end of said positioning channel, and said support member being latched by the extension of said resilient member, and said ground terminal being extended out from said ground wire hole, and said live terminal and neutral terminal being turned round and extended out from said terminal channels such that the latch presses said support member to constitute a 3-terminal connector.

2. The link assembly for connectors of claim 1, wherein said main body comprises an upper casing and a lower casing coupled with each other.

3. The link assembly for connectors of claim 1, wherein said main body comprises a connector module having a live wire insert hole, a neutral wire insert hole, and a ground wire insert hole, said each insert hole having a live wire connecting plate, a neutral wire connecting plate, and a ground wire connecting plate, and each connecting plate is electrically connected to said live, neutral, and ground terminals respectively.

4. The link assembly for connectors of claim 1, wherein said positioning channel and said rod latch are in the shape of a cross.

5. The link assembly for connectors of claim 1, wherein said axle rod is pressed and fixed by a limit press board disposed in said main body, and both ends of said axle ring is coupled by an axle arc on said limit press board, and both ends of a long protrusion protruded from the periphery of said ring are in contact with both ends of said axle arc to define an turning angle.

6. The link assembly for connectors of claim 1, wherein said ground terminal at its end comprises a pair of clamping plates for clamping said ground connecting plate.

7. The link assembly for connectors of claim 1 further comprising a latch device installed at the opening above said ground wire hole between said two terminal channels and being sheathed into a seal lid by a contractible member and one side of said blocking plate being extended out from said plate groove of said seal lid to shut a terminal channel, and an aslant surface being disposed on said contractible member, and a resilient member being coupled indirectly to said latch on the other side of said seal lid; a sliding member being protruded from the base of said ground terminal corresponding to said aslant surface, such that said sliding member moves forward and touches said aslant surface to moves its side and said blocking plate being withdrawn into said seal lid to open said terminal channel and turn said live terminal and neutral terminals round.

* * * * *